US009789932B2

(12) United States Patent
van Wijk et al.

(10) Patent No.: US 9,789,932 B2
(45) Date of Patent: Oct. 17, 2017

(54) SYSTEM AND METHOD FOR INSTALLING SUCTION PILES

(71) Applicants: Shell Oil Company, Houston, TX (US); Cameron International Corporation, Houston, TX (US)

(72) Inventors: Johannes van Wijk, GS Rijswijk (NL); Melvyn F. Whitby, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/952,668

(22) Filed: Nov. 25, 2015

(65) Prior Publication Data

US 2017/0144732 A1 May 25, 2017

(51) Int. Cl.

| | |
|---|---|
| ***B63B 21/27*** | (2006.01) |
| ***E02D 7/28*** | (2006.01) |
| *B63B 21/00* | (2006.01) |

(52) U.S. Cl.

CPC ..... *B63B 21/27* (2013.01); *E02D 7/28* (2013.01); *B63B 2021/007* (2013.01); *E02D 2250/0053* (2013.01)

(58) Field of Classification Search

USPC ..... 405/224, 224.1, 228, 232

See application file for complete search history.

(56) References Cited

U.S. PATENT DOCUMENTS

| | | | | |
|---|---|---|---|---|
| 4,318,641 | A * | 3/1982 | Hogervorst | B63B 21/27 114/296 |
| 8,021,082 | B2 * | 9/2011 | Thomas | B63B 21/27 114/296 |
| 9,140,090 | B2 | 9/2015 | van Wijk et al. | |
| 2007/0140796 | A1 * | 6/2007 | Alhayari | B63B 21/27 405/224.1 |
| 2011/0123277 | A1 * | 5/2011 | Westerbeek | E02D 7/02 405/228 |
| 2013/0098628 | A1 * | 4/2013 | Van Wijk | E21B 33/0355 166/368 |

OTHER PUBLICATIONS http://www.thefreedictionary.com/suction.*

* cited by examiner

*Primary Examiner* — Sean Andrish
(74) *Attorney, Agent, or Firm* — Chamberlain Hrdlicka

(57) ABSTRACT

The present disclosure generally relates to a system and method for installing a tubular element, such as a suction pile, in a bottom of a body of water. The system comprises a tubular element and a deintensifier in fluid communication with the tubular element. The deintensifier is configured to be exposed to an ambient pressure external to the tubular element and reduce pressure within the tubular element. The method comprises lowering the tubular element to the bottom of the body of water, filling the tubular element with water at ambient pressure, and exposing the water within the tubular element to a deintensified external ambient pressure so as to withdraw the water out of the tubular element.

19 Claims, 2 Drawing Sheets

SYSTEM AND METHOD FOR INSTALLING SUCTION PILES

BACKGROUND

This section is intended to introduce the reader to various aspects of art that may be related to various aspects of the presently described embodiments. This discussion is believed to be helpful in providing background information to facilitate a better understanding of the present embodiments. Accordingly, it should be understood that these statements are to be read in this light, and not as admissions of prior art.

During offshore drilling and production operations, surface facilities must be maintained in position over a subsea well site. This often requires the deployment of an array of mooring lines, each anchored to the sea floor with a hollow steel tubular element referred to as a "suction pile" or "suction caisson." Typically, suction piles are installed by lowering the pile subsea with the use of a crane. Once at the sea floor, the suction pile is allowed to sink into the sea floor by virtue of its own weight. A remotely operated vehicle pumping system then sucks the water entrapped in the pile in order to drive it down to a designed penetration. When target penetration is achieved, one or more valves on top of the pile are closed to prevent suction loss. There is no active suction maintained, but as the valve is closed, any uplift load will create an under-pressure within the pile that tends to suck the soil into the pile's body. This installation process is time consuming and requires considerable offshore equipment.

Accordingly, a system and method for installing suction piles that accelerates the installation process and reduces equipment complexity is desirable.

BRIEF DESCRIPTION OF THE DRAWINGS

For a more detailed description of the embodiments, reference will now be made to the following accompanying drawings.

The illustrated figures are only exemplary and are not intended to assert or imply any limitation with regard to the environment, design, or process in which different embodiments may be implemented.

DETAILED DESCRIPTION OF ILLUSTRATIVE EMBODIMENTS

The system and method of this disclosure provide a means for installing a generally hollow tubular element, such as a suction pile, in the bottom of a body of water, such as a sea floor. The system includes the tubular element and one or more deintensifiers coupled thereto. When the tubular element rests on the bottom of the body of water, the deintensifier draws water from the interior of the tubular element, thereby reducing the pressure within the tubular element. In this way, a pressure differential is created between the interior of the tubular element and the external environment. The pressure differential causes a gradual penetration of the tubular element into the bottom of the body of water until it has reached its desired penetration. The suction pile can then be used to moor a floating object, such as a vessel or a floating platform.

Figure 1:
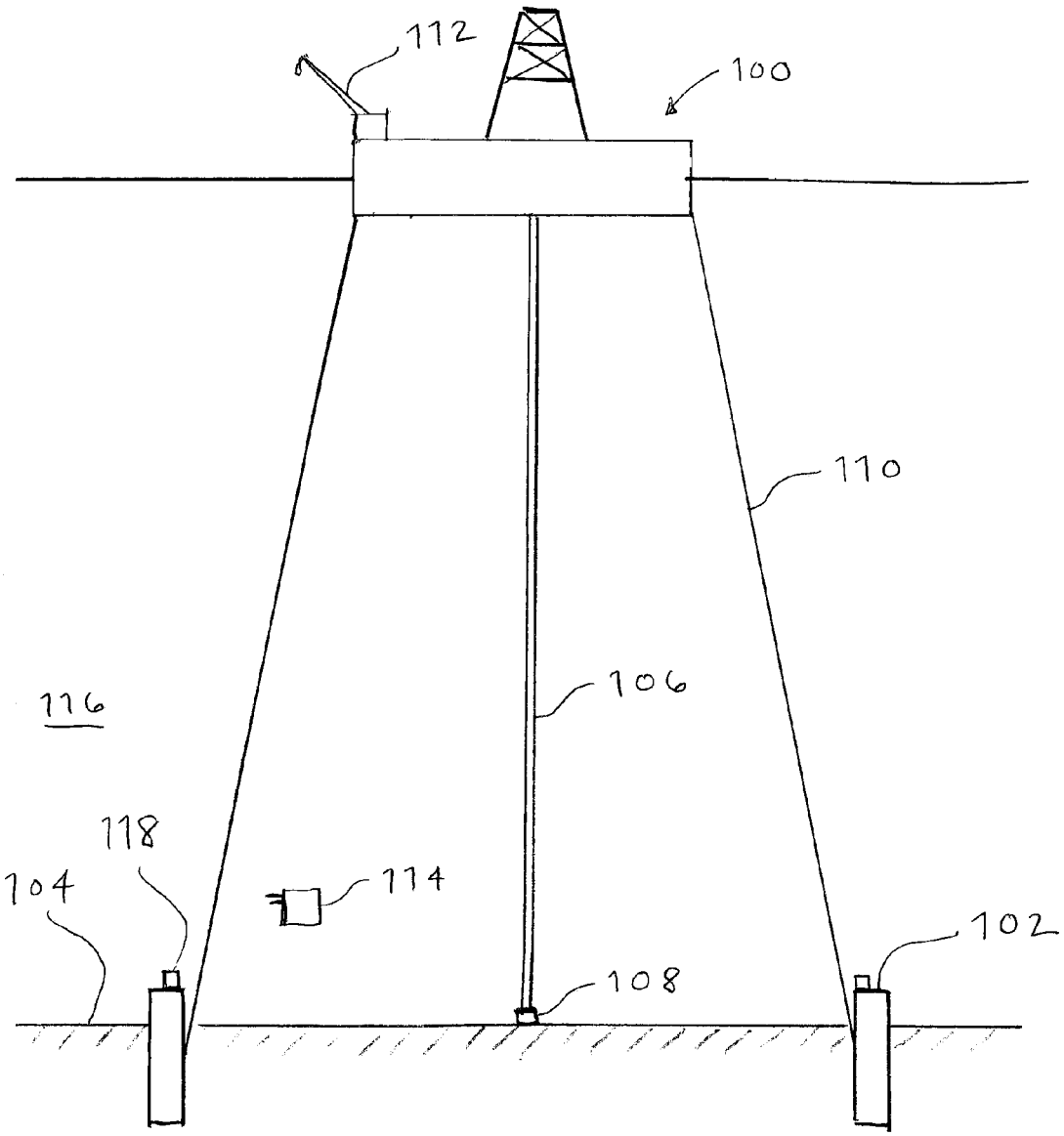
FIG. 1 illustrates a schematic view of a marine vessel for offshore drilling and production activities anchored by suction piles installed at a sea floor according to one or more embodiments.

FIG. 1 shows a schematic view of a marine vessel 100 for offshore drilling and production activities anchored by suction piles 102 installed at a sea floor 104 in accordance with various embodiments. A marine riser 106 extends from a subsea wellhead assembly 108 on the sea floor 104 up to the marine vessel 100. The marine riser 106 comprises a series of riser segments connected end-to-end and extending from the sea floor 104 to the marine vessel 100 at the water's surface. In this way, fluid communication is established between the wellhead assembly 108 and marine vessel 100. The marine vessel 100 is kept in place over the wellhead assembly 108 by mooring lines 110 tethered to the suction piles 102.

During installation of the suction piles 102, the suction piles 102 can be delivered to the sea floor 104 by the use of a crane 112 located on the marine vessel 100 together with a remotely operated vehicle 114. The suction piles 102 fill with water while being lowered to the sea floor 104. Once on the sea floor 104, the suction piles sink into the sea floor 104 under their own weight.

To install the suction piles 102 further into the sea floor, the water within the suction piles 102 is removed, thereby creating a pressure differential between the interior of the suction piles 102 and the environment external 116 to the suction piles 102, i.e., the body of water. One or more deintensifiers 118 can be used to remove the water from the interior of the suction piles 102. The water can be removed from the suction piles 102 solely by the deintensifiers 118 or, alternatively, the deintensifiers 118 in conjunction with a traditional pumping system used to install suction piles (not shown).

Figure 2:
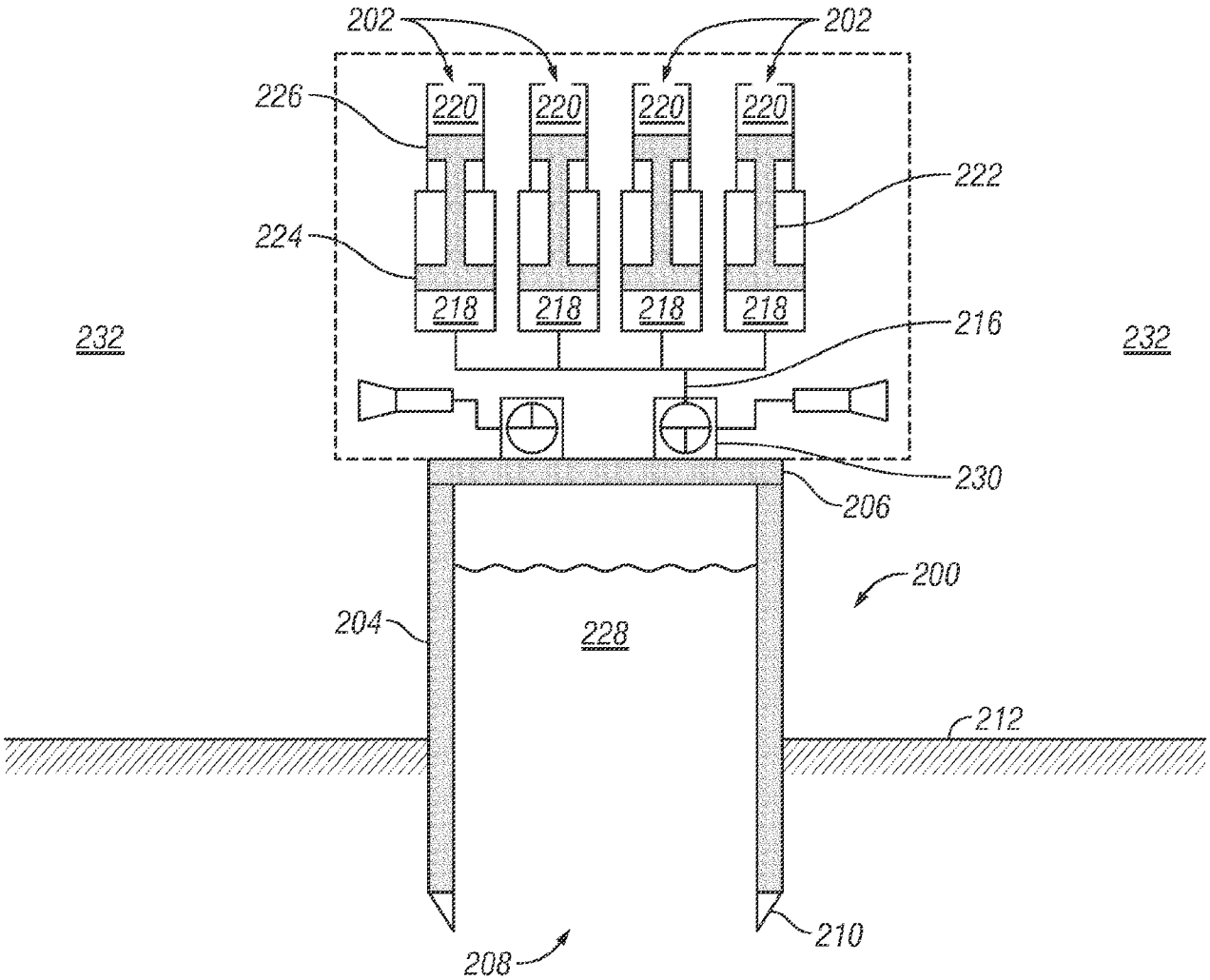
FIG. 2 illustrates a schematic view of a suction pile and a plurality of deintensifiers.

FIG. 2 shows a schematic view of a suction pile 200 and a plurality of deintensifiers 202 in accordance with one or more embodiments. The suction pile 200 includes a cylindrical and generally hollow body 204. The body 204 can be made from any suitable material, such as steel. The suction pile 200 further includes an end cap 206 at the top of the suction pile 200 and an open lower end 208. The suction pile 200 includes a cutting feature 210 located on the lower end of the suction pile 200. The cutting feature 210 is configured to enhance the penetration of the suction pile into the sea floor 212 during installation procedures.

The deintensifiers 202 are shown located on top of the suction pile end cap 206 in the illustrated embodiment. However, the deintensifiers 202 can be located anywhere on the suction pile body 204. In particular, the deintensifiers 202 are arranged in parallel and capable of fluid communication with the suction pile via fluid communication line 216. In alternative embodiments, the deintensifiers 202 can be arranged only in series, or in a combination of in series and in parallel. A deintensifier valve 230 is operable by a remotely operated vehicle to open or close fluid communication between the deintensifier 202 and the suction pile 200.

Each deintensifier 202 includes a suction chamber 218 and an ambient chamber 220 separated by a piston 222. The piston 222 fluidly seals the suction chamber 218 from the ambient chamber 220. Each piston 222 includes a suction piston 224 located in the suction chamber 218 and in pressure communication with a fluid 228 located in the suction pile 200 and ambient piston 226 located in the ambient chamber 220 and in pressure communication with an external subsea environment 232. Each ambient piston 226 has a smaller surface area than that of the suction piston 224. As a result, the pressure of the external subsea environment acting on ambient piston 226 will be deintensified and a reduced pressure will be achieved in the suction chamber 218. In this way, the deintensifiers 202 create a pressure differential between the interior and exterior of the suction pile 200 and withdraw the fluid 228 from the suction pile 200. As a result, the vacuum created creates a downward force on the suction pile 200 such that the suction pile 200 gradually penetrates into the sea floor 212 as the fluid 228 is withdrawn from the suction pile.

The ratio between the surface area of ambient piston 226 and suction piston 224 can be varied to achieve the desired pressure deintensification in suction chamber 218. In some embodiments, the deintensifiers 202 are designed with enough cumulative volume in suction chambers 218 to ensure that all or nearly all of the fluid 228 within suction pile 200 can be withdrawn. Once the desired amount of fluid 228 is withdrawn and the suction pile has reached the desired penetration depth, the deintensifiers 202 can be removed and a mooring line (such as mooring line 110 in FIG. 1) can be coupled to the suction pile to enable a surface vessel to be moored in place.

In addition to the embodiments described above, many examples of specific combinations are within the scope of the disclosure, some of which are detailed below:

Example 1

A system for installing a tubular element in a bottom of a body of water, comprising:

the tubular element comprising a body which is open at an end; and a deintensifier comprising an ambient chamber and a suction chamber separated by a piston, the ambient chamber configured to receive ambient pressure from an external subsea environment and the suction chamber configured to be in fluid communication with an internal volume of the tubular element.

Example 2

The system of Example 1, wherein the piston is configured to transfer pressure from the ambient chamber to the variance chamber, thereby reducing the pressure within the body of the tubular element and urging the tubular element to penetrate into the bottom of the body of water.

Example 3

The system of Example 1, further comprising a plurality of deintensifiers.

Example 4

The system of Example 3, wherein the plurality of deintensifiers are arranged in series.

Example 5

The system of Example 3, wherein the plurality of deintensifiers are arranged in parallel.

Example 6

The system of Example 3, wherein a cumulative volume of the suction chambers is equal to or greater than the internal volume of the tubular element.

Example 7

The system of Example 1, wherein the deintensifier is configured to be in fluid communication with the tubular element via a fluid communication line comprising a valve configured to regulate fluid flow between the deintensifier and the tubular element.

Example 8

The system of Example 7, wherein the valve is operable by a remotely operated vehicle.

Example 9

The system of Example 1, further comprising a pump in fluid communication with the tubular element and configured to reduce the pressure within the body of the tubular element.

Example 10

The system of Example 1, the tubular element further comprising a cutting feature located circumferentially about the end.

Example 11

A deintensifier for securing a tubular element in a bottom of a body of water, the deintensifier comprising:

an ambient chamber configured to receive ambient pressure from an external subsea environment;

a suction chamber configured to be in fluid communication with an internal volume of the tubular element; and a piston separating hydraulically sealing the ambient chamber from the suction chamber.

Example 12

The deintensifier of Example 11, wherein the piston is configured to transfer pressure from the ambient chamber to the suction chamber, thereby reducing the pressure within the tubular element and urging the tubular element to penetrate into the bottom of the body of water.

Example 13

The deintensifier of Example 11, wherein the deintensifier is configured to be in fluid communication with the tubular element via a fluid communication line comprising a valve configured to regulate fluid flow between the deintensifier and the tubular element.

Example 14

The deintensifier of Example 13, wherein the valve is operable by a remotely operated vehicle.

Example 15

The deintensifier of Example 11, wherein the deintensifier is configured to be retrofittedly coupled to the tubular element.

Example 16

The deintensifier of Example 11, wherein the deintensifier is retrievable by a remotely operated vehicle.

Example 17

A method for securing a tubular element in a bottom of a body of water, comprising:

lowering the tubular element to the bottom of the body of water;

filling the tubular element with water at ambient pressure; and exposing the water within the tubular element to a deintensified external ambient pressure so as to withdraw the water out of the tubular element.

Example 18

The method of Example 17, further comprising withdrawing water from the tubular element to reduce the pressure within the tubular element.

Example 19

The method of Example 17, further comprising:

mounting a deintensifier onto the tubular element, the deintensifier comprising an ambient chamber configured to receive ambient pressure from an external subsea environment and a suction chamber configured to be in fluid communication with an internal volume of the tubular element, the ambient chamber and suction chamber separated by a piston; and transferring pressure from the ambient chamber to the suction chamber via the piston, thereby reducing the pressure within the tubular element and urging the tubular element to penetrate into the bottom of the body of water.

Example 20

The method of Example 17, further comprising pumping water from the tubular element with a pump to reduce the pressure within the tubular element.

This discussion is directed to various embodiments of the present disclosure. The drawing figure is not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout this description and claims to refer to particular features or components. As one skilled in the art will appreciate, different persons may refer to the same feature or component by different names. This document does not intend to distinguish between components or features that differ in name but are the same structure or function. The drawing figure is not necessarily to scale. Certain features and components herein may be shown exaggerated in scale or in somewhat schematic form and some details of conventional elements may not be shown in interest of clarity and conciseness.

In this discussion and in the claims, the terms "including" and "comprising" are used in an open-ended fashion, and thus should be interpreted to mean "including, but not limited to . . . ."

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

We claim:

1. A system for installing a tubular element in a bottom of a body of water, comprising:

the tubular element comprising a body which is open at an end; and a deintensifier comprising:

an ambient chamber comprising an ambient piston positioned within the ambient chamber, the ambient chamber configured to receive ambient pressure from an external subsea environment; and a suction chamber comprising a suction piston positioned within the suction chamber with the suction piston connected to the ambient piston through a rod, the suction chamber configured to be in fluid communication with an internal volume of the tubular element.

2. The system of claim 1, wherein the ambient piston, the suction piston, and the rod are configured to transfer pressure from the ambient chamber to the suction chamber, thereby reducing the pressure within the body of the tubular element and urging the tubular element to penetrate into the bottom of the body of water.

3. The system of claim 1, further comprising a plurality of deintensifiers.

4. The system of claim 3, wherein the plurality of deintensifiers are arranged in series.

5. The system of claim 3, wherein the plurality of deintensifiers are arranged in parallel.

6. The system of claim 3, wherein a cumulative volume of the suction chambers is equal to or greater than the internal volume of the tubular element.

7. The system of claim 1, wherein the deintensifier is configured to be in fluid communication with the tubular element via a fluid communication line comprising a valve configured to regulate fluid flow between the deintensifier and the tubular element.

8. The system of claim 7, wherein the valve is operable by a remotely operated vehicle.

9. The system of claim 1, further comprising a pump in fluid communication with the tubular element and configured to reduce the pressure within the body of the tubular element.

10. The system of claim 1, the tubular element further comprising a cutting feature located circumferentially about the end.

11. A deintensifier for securing a tubular element in a bottom of a body of water, the deintensifier comprising:

an ambient chamber configured to receive ambient pressure from an external subsea environment;

a suction chamber configured to be in fluid communication with an internal volume of the tubular element; and a piston separating and hydraulically sealing the ambient chamber from the suction chamber;

wherein the deintensifier is configured to be in fluid communication with the tubular element via a fluid communication line comprising a valve configured to regulate fluid flow between the deintensifier and the tubular element.

12. The deintensifier of claim 11, wherein the piston is configured to transfer pressure from the ambient chamber to the suction chamber, thereby reducing the pressure within the tubular element and urging the tubular element to penetrate into the bottom of the body of water.

13. The deintensifier of claim 11, wherein the valve is operable by a remotely operated vehicle.

14. The deintensifier of claim 11, wherein the deintensifier is configured to be retrofittedly coupled to the tubular element.

15. The deintensifier of claim 11, wherein the deintensifier is retrievable by a remotely operated vehicle.

16. A method for securing a tubular element in a bottom of a body of water, comprising:

lowering the tubular element to the bottom of the body of water;

filling the tubular element with water at ambient pressure; and exposing the water within the tubular element to a deintensified external ambient pressure so as to withdraw the water out of the tubular element.

17. The method of claim 16, further comprising withdrawing water from the tubular element to reduce the pressure within the tubular element.

18. The method of claim 16, further comprising:

mounting a deintensifier onto the tubular element, the deintensifier comprising an ambient chamber configured to receive ambient pressure from an external subsea environment and a suction chamber configured to be in fluid communication with an internal volume of the tubular element, the ambient chamber and the suction chamber separated by a piston; and transferring pressure from the ambient chamber to the suction chamber via the piston, thereby reducing the pressure within the tubular element and urging the tubular element to penetrate into the bottom of the body of water.

19. The method of claim 16, further comprising pumping water from the tubular element with a pump to reduce the pressure within the tubular element.

* * * * *